United States Patent [19]

Sigerist

[11] Patent Number: 4,642,954

[45] Date of Patent: Feb. 17, 1987

[54] DOORJAMB ASSEMBLY

[75] Inventor: Helmut Sigerist, Fort Langley, Canada

[73] Assignee: Venturetech Enterprises, Inc., Vancouver, Canada

[21] Appl. No.: 751,002

[22] Filed: Jul. 2, 1985

[51] Int. Cl.[4] ..... E06B 1/04

[52] U.S. Cl. ..... 52/204; 52/504

[58] Field of Search ..... 52/204, 211, 212, 213, 52/214; 49/504, 489

[56] References Cited

U.S. PATENT DOCUMENTS

| | | | |
|---|---|---|---|
| 1,245,018 | 10/1917 | Peribonis | 49/504 |
| 2,309,452 | 1/1943 | Hasenburger et al. | 49/504 |
| 3,224,152 | 12/1965 | Evans | 52/211 X |
| 3,287,856 | 11/1966 | Passovoy | 49/504 |
| 3,354,586 | 11/1967 | Den Besten | 49/504 |
| 3,793,788 | 2/1974 | Collins | 52/211 |
| 3,964,214 | 6/1976 | Wendt | 52/204 X |
| 4,015,382 | 4/1977 | Noyes | 52/204 |
| 4,223,494 | 9/1980 | Wendt | 52/211 |

*Primary Examiner*—William F. Pate, III
*Assistant Examiner*—Creighton Smith
*Attorney, Agent, or Firm*—Kolisch, Hartwell & Dickinson

[57] ABSTRACT

A doorjamb assembly that includes an elongate jamb element and an elongate doorstop element secured through fasteners to the face of the jamb element. Provision is made for sealing the two elements. The jamb element has a recessed channel receiving the doorstop element.

8 Claims, 3 Drawing Figures

DOORJAMB ASSEMBLY

BACKGROUND AND SUMMARY OF THE INVENTION

This invention relates to a doorjamb assembly, and more particularly to a doorjamb assembly which is adapted to metal fabrication and lends itself to being overlaid where visually exposed and after installation with a decorative overlay such as a veneer overlay.

Metallic doorjambs are currently known, and use of such doorjambs is frequently dictated in commercial and other types of buildings to comply with local fire codes. However, the construction of known doorjambs of this description is such that the application of any decorative overlay to visually exposed surfaces is difficult and not performable with conventional high production equipment known in the industry. As a consequence, it has been almost universally the practice to paint visually exposed surfaces of metal doorjambs, which is a limitation from an architectural standpoint.

A general object of this invention, therefore, is to provide a new and improved doorjamb assembly constructed in such a manner as to facilitate the application of an overlay to visually exposed surfaces with the jamb assembly installed.

Another object is to provide a doorjamb assembly which features a doorstop element formed as a separate part from a jamb element in the assembly. The two elements are secured together to form the complete doorjamb assembly.

Yet a further object of the invention is to provide a doorjamb assembly which has two elements as described and which, in the complete assembly, will comply with local fire ordinances.

A still further object is to provide such a doorjamb assembly which includes within the assembly an elastomer seal which functions as a smoke barrier.

The doorjamb assembly as contemplated may be conveniently made with the jamb element described formed from sheet steel. The doorstop element which is secured by fasteners to the jamb element lends itself for production as an extrusion.

The foregoing and other objects and advantages are attained by the invention, which is described hereinbelow in conjunction with the accompanying drawings, wherein.

Figure 2:
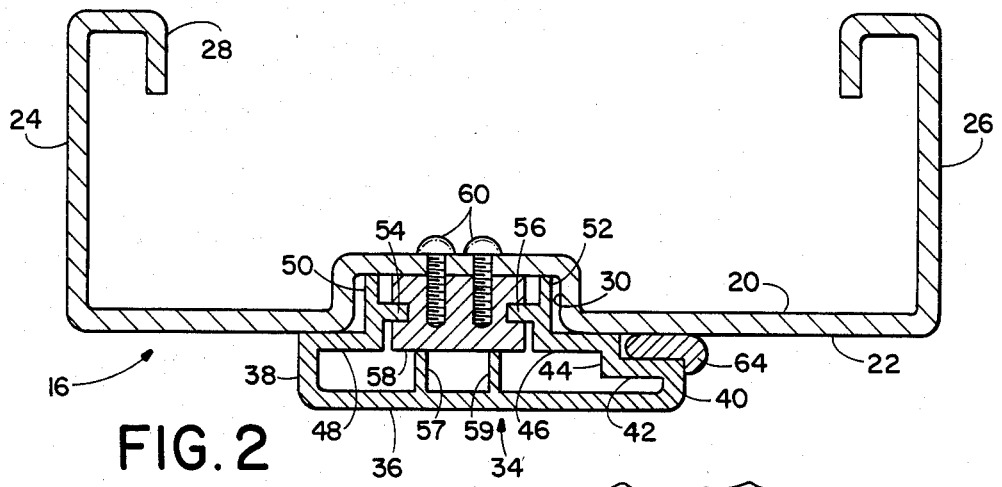
FIG. 2 is a cross-sectional view taken generally along the line 2—2 in FIG. 1, and on an enlarged scale, further illustrating the doorjamb assembly.
Figure 1:
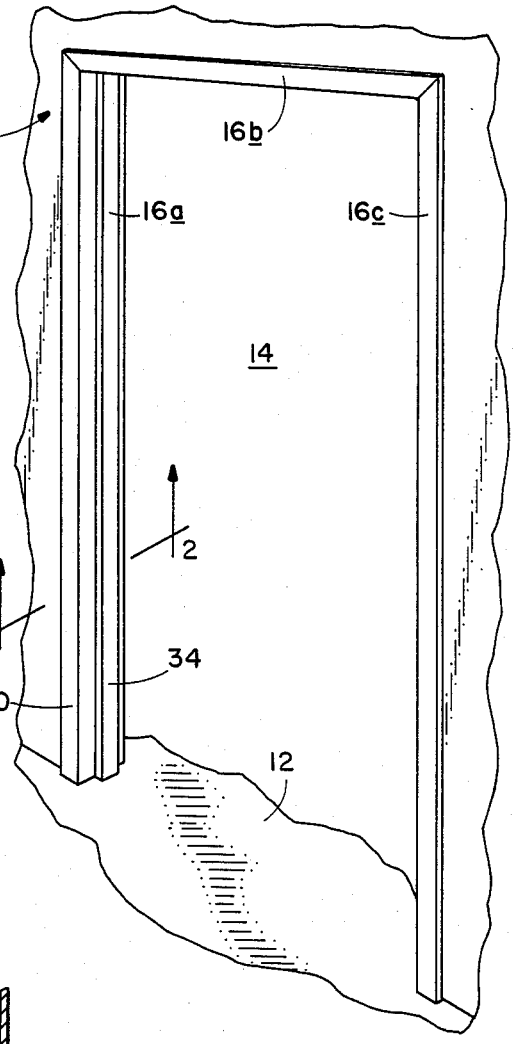
FIG. 1 is a perspective view illustrating a door opening such as might be found in a building with such bounded by the doorjamb assembly of the invention.

Referring now to the drawings, indicated generally at 10 are portions of a building wall extending upwardly from a floor 12. Bounding a door opening 14 are segments 16*a*, 16*b*, and 16*c* of a doorjamb assembly indicated generally at 16. Omitted from the drawing, as not necessary for an understanding of the invention, is the usual door which is hinged to one of the upstanding doorjamb assembly segments and which, when swung to a closed position, closes off door opening 14.

Figure 3:
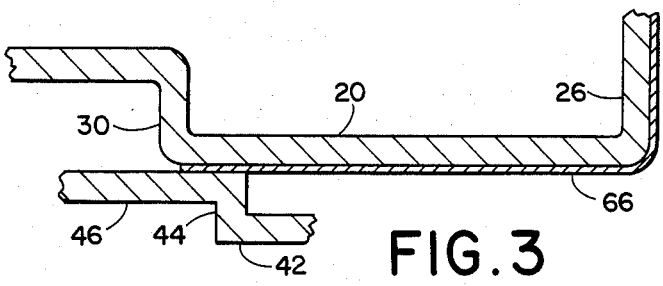
FIG. 3 is a cross-sectional view, resembling portions of FIG. 2, but on an even larger scale, illustrating placement of an overlay in the doorjamb assembly.

Details of the doorjamb assembly are illustrated in greater detail in FIGS. 2 and 3. Referring now more in particular to these figures, the assembly comprises what is referred to herein as an elongate jamb element 20 which forms in essence the body of the doorjamb assembly. Jamb element 20 includes what is referred to as a face side 22, this being the side which faces the door opening with the assembly installed. What are referred to as margin sides 24, 26 are integrally joined with the face side along opposite margins of the face side and these margin sides are disposed generally normal to the plane of the face side. The margin sides terminate in reversely turned portions as exemplified by reversely turned portion 28 for margin side 24.

It is preferred that the face side be formed with an elongate channel extending longitudinally along the jamb element in a region intermediate the margin sides of the jamb element and as illustrated by channel 30. The channel is indented inwardly, which is to say away from the door opening which the jamb element faces.

The jamb element may be conveniently prepared from sheet steel appropriately formed in a bending and shaping process.

Also part of the jamb assembly is what is referred to herein as a doorstop element indicated at 34. Such comprises an elongate piece which is mounted against the face side of the jamb element.

Considering details of this doorstop element, such includes an outer side 36, and joining with this outer side an edge 38, which extends rearwardly of the outer side to contact with the face side of the doorjamb element. Also joined with side 36 is an edge 40. This edge, however, terminates short of the face side of the jamb element. More specifically, edge 40 joins with a ledge 42 having an outer ledge surface which parallels but is spaced from the surface of the face side of jamb element 20. Ledge 42 at its inner margin joins with an upstanding web 44. Web 44 and edge 38 join with base expanses 46, 48, respectively.

The doorstop element is provided with ridge structure projecting from its base or the side thereof which faces the doorjamb element. Specifically, such comprises opposed parallel elongate flange portions 50, 52 extending in planes substantially normal to the base of the doorstop element. With the stop element in place, this ridge structure sits within channel 30.

Integral with flange portions 50, 52 are inwardly extending ribs or ridges 54, 56. These ridges provide a mounting for clips used in securing the stop element in the assembly.

Also part of the doorstop element and extending along its length in its interior are spaced, back-up flanges 57, 59.

A clip is shown at 58 in FIG. 2, where the clip is viewed in cross-section. The clip may have a length which is approximately twice its width, and successive clips may be spaced, for instance, every foot or foot-and-one-half, along the length of the doorstop element. The clip is a solid element and has grooves on opposite sides receiving ridges 54, 56 presented by the stop element.

Each clip includes threaded bores extending thereinto and, these bores receive detachable fasteners exemplified by the screws shown at 60.

With the screws in place, the clips distributed along the length of the stop element serve to draw tightly the stop element against the face side of the jamb element in the assembled jamb assembly.

The outer surface of ledge 42 and the outer surface of face side 22, where such underlies the ledge, cooperate to define an elongate groove or channel extending under one edge of the doorstop element. This groove receives a smoke seal element 64 which may be made of a fire retardant elastomer material. This seal element is compressed within the groove receiving it with final installation of the stop element. The door which closes the door opening comes up against the protruding portion of the seal element with the door in a closed position.

The doorstop element may be an extruded item such as an aluminum extrusion.

By reason of the construction described, the doorstop element has a hollow interior. In a preferred embodiment, and in the final assembly, it is contemplated that such hollow interior be filled with a fire resistant non-heat conductive insulating material.

As probably best illustrated in FIG. 3, it should be evident that prior to assembly of the doorstop element with the jamb element, visually exposed portions of the jamb element may be overlaid with a decorative overlay such as a veneer overlay. This is depicted in FIG. 3 by veneer overlay 66. Such is bonded to the outer surface of the jamb element with an appropriate adhesive. The construction of the jamb element is such that it may, if desired, be overlaid with two types of material. For instance, the visually exposed part of the jamb element which faces one side of the space closed by the door may be one type of veneer, and the visually exposed part of the jamb element which faces the other side of the space closed by the door may be surfaced with a different type of veneer. The veneer selection would be determined by compatibility with the decor of the spaces involved.

The doorjamb assembly is constructed in such a manner as to meet most restrictions imposed by local fire codes. Important in this connection is the internal construction of the doorstop element and the provision of the ridge structure in this stop element which projects into and seats within the channel formed in the facing side of the door jamb element.

While a particular embodiment of the invention has been described, it should be obvious that variations and modifications are possible without departing from the invention.

It is claimed and desired to secure by Letters Patent:

1. A doorjamb assembly comprising an elongate jamb element having a face side that faces a door opening with the assembly installed and opposed spaced elongate margin sides joined with the face side along opposite margins of the face side and disposed generally normal to the face side, an elongate doorstop element adjacent and outwardly of said face side of the jamb element, said stop element having a base that faces the jamb element and opposed side edges extending along the length of the doorstop element, fastener means securing said stop element to the face side of the jamb element, said doorstop element having an elongate interior ledge surface disposed rearwardly on the doorstop element from the base of the doorstop element and joining along one margin with a side edge of the element and defining, in cooperation with an expanse of the face side of said jamb element, a groove extending the length of the stop element, and an elongate sealing means extending along and seated within said groove, said face side of said doorjamb element having a channel formed therein indented from the plane of the face side and extending longitudinally thereof intermediate the margin sides of the element, said doorstop element having a ridge structure along the base thereof and facing the jamb element which seats within said channel.

2. The assembly of claim 1, wherein said ridge structure comprises parallel spaced flange portions integral with the doorstop element having bottom edges that are adjacent the base of said channel, said flange portions including oppositely disposed ridges extending therealong, and wherein said fastener means secures to said ridges.

3. A doorjamb assembly comprising an elongate metal jamb element having a face side that faces a door opening with the assembly installed and opposed spaced elongate margin sides joined with the face side along opposite margins of the face side, said face and margin sides imparting a generally channel-shaped cross section to the jamb element, an elongate channel formed in the face side of the jamb element extending longitudinally therealong in a region intermediate the margin sides of the jamb element and indented inwardly from the plane of the face side, an elongate doorstop element having a base that faces the jamb element, said doorstop element along its length having ridge structure projecting from the base thereof fitting within said channel, and fastener means securing said doorstop element to the face side of the jamb element.

4. The doorjamb assembly of claim 3, wherein said ridge structure comprises parallel spaced flange portions integral with the doorstop element disposed with bottom edges that are adjacent the base of said channel.

5. The doorjamb assembly of claim 4, wherein said spaced flange portions have oppositely disposed ridges extending therealong, and said fastener means secures to said ridges.

6. The doorjamb assembly of claim 3, wherein said base of said doorstop element along a margin of said doorstop element is defined by a ledge surface disposed in a plane which is rearwardly of the plane of the remainder of the base, said ledge surface and a portion of the face side of said jamb element cooperating to define a seal-receiving groove extending along a side edge of the doorstop element, and which further includes elongate sealing means extending along and seated within said seal-receiving channel.

7. The doorjamb assembly of claim 3, wherein said doorstop element comprises an elongate hollow extrusion with a hollow interior located rearwardly of said ridge structure, and wherein said hollow interior is filled with a relatively nonconductive heat insulating material.

8. A doorjamb assembly comprising:

an elongate metal jamb element having a face side that faces a door opening with the assembly installed and opposed spaced elongate margin sides joined with the face side along opposite margins of the face side, said face and margin sides imparting a generally channel-shaped cross section to the jamb element, an elongate channel formed in the face side of the jamb element extending longitudinally therealong in a region intermediate the margin sides of the jamb element and indented inwardly from the plane of the face side, an elongate doorstop element having a base that faces and is adjacent the face side of the jamb element, said doorstop element along its length having ridge structure projecting from the base of the doorstop element fitting within said channel, said ridge structure of the doorstop element further including rib means used in securing the doorstop element to the jamb element.

* * * * *